US006368073B1

(12) United States Patent
Kanai et al.

(10) Patent No.: US 6,368,073 B1
(45) Date of Patent: Apr. 9, 2002

(54) SWASH PLATE COMPRESSOR

(75) Inventors: Hiroshi Kanai; Shunichi Furuya, both of Saitama-ken (JP)

(73) Assignee: Zexel Corporation, Tokyo (JP)

( * ) Notice: Subject to any disclaimer, the term of this patent is extended or adjusted under 35 U.S.C. 154(b) by 0 days.

(21) Appl. No.: 09/585,043

(22) Filed: Jun. 1, 2000

Related U.S. Application Data

(63) Continuation-in-part of application No. 09/081,510, filed on May 20, 1998, now Pat. No. 6,095,761.

(30) Foreign Application Priority Data

May 26, 1997 (JP) ..... 9-151656

(51) Int. Cl.[7] ..... F04B 1/14
(52) U.S. Cl. ..... 417/269; 92/71
(58) Field of Search ..... 92/71; 417/222.2, 417/269, 270

(56) References Cited

U.S. PATENT DOCUMENTS

| | | | | |
|---|---|---|---|---|
| 3,183,848 A | | 5/1965 | Raymond | |
| 3,380,651 A | | 4/1968 | Niki | |
| 3,557,664 A | | 1/1971 | Akaike | |
| 3,939,717 A | | 2/1976 | Teisen | |
| 4,763,563 A | * | 8/1988 | Ikeda et al. | 417/269 |
| 4,950,132 A | * | 8/1990 | Brian et al. | 417/269 |
| 5,056,417 A | * | 10/1991 | Kato et al. | 92/71 |
| 5,382,139 A | | 1/1995 | Kawaguchi et al. | |
| 5,615,599 A | | 4/1997 | Terauchi | |
| 5,706,716 A | * | 1/1998 | Umemura | 417/269 |
| 5,738,000 A | | 4/1998 | Forster | |
| 5,809,863 A | * | 9/1998 | Tominaga et al. | 92/71 |
| 5,897,298 A | | 4/1999 | Umemura | |

* cited by examiner

*Primary Examiner*—Michael Koczo
(74) *Attorney, Agent, or Firm*—Frishauf, Holtz, Goodman, Langer & Chick, P.C.

(57) ABSTRACT

A swash plate compressor including a housing secured to a cylinder block having cylinder bores axially formed therethrough for receiving respective pistons therein. A swash plate is mounted on a drive shaft extending through a crankcase defined within the housing, for rotation in unison with the drive shaft. The swash plate has sliding surfaces on opposite sides thereof. A pair of shoes, each of which has a substantially semispherical shape, which slide on the sliding surfaces of the swash plate. Each piston is connected to the swash plate via a corresponding pair of the shoes, and performs a linear reciprocating motion within a corresponding cylinder bore. Guide grooves are each axially formed in an inner peripheral wall of the housing along a path of the linear reciprocating motion of the corresponding piston. Each piston has a body having a first concave portion for supporting a corresponding pair of the shoes, a swash plate-side end having a second concave portion for supporting another of the corresponding pair of the shoes, and a bridge integrally connecting the body and the swash plate-side end such that these portions are axially opposed to each other with space therebetween. The bridge extends radially outward with respect to an outer peripheral surface of the body, and is slidably fitted in a corresponding guide groove. The pistons are made of an aluminum-based material and the shoes are made of an iron-based material. A ratio of an outer diameter of the body to a diameter of an imaginary sphere formed by the corresponding pair of the pairs of shoes is 8/10 to 9/10.

7 Claims, 3 Drawing Sheets

5
27
26 23
33
4
40
40a
41
43
61
72
60
73
70
7
6
71
1
15
2
13
3
3a
21
3b
19
12
13
17
16
18
16
17
15
21
6
20
62
61b
II
II
47
9
10a
8
10a
46
44
42
24
22
25
73
70
10
60
61
61a

SWASH PLATE COMPRESSOR

This application is a continuation-in-part application of application Ser. No. 09/081,510, filed May 20, 1998 U.S. Pat. No. 6,095,761.

BACKGROUND OF THE INVENTION

1. Field of the Invention

This invention relates to a swash plate compressor.

2. Background Information

In general, a swash plate compressor includes a swash plate which is fitted on a drive shaft, for rotation in unison with the drive shaft, and a plurality of pistons each of which is connected to the swash plate via a pair of generally hemispherical shoes sliding on front and rear sliding surfaces of the swash plate, respectively, for reciprocation within a cylinder bore according to the rotation of the swash plate.

Each of the pistons is comprised of a body formed with a first concave portion for slidably supporting one of the shoes, a front end portion formed with a second concave portion for slidably supporting the other of the shoes, and a bridge integrally formed with the body and the front end portion for connecting the two portions to each other.

The first and second concave portions are opposed to each other axially, i.e., in a direction of reciprocation of the piston with space therebetween.

The pair of shoes are arranged on opposite outer peripheral portions of the swash plate such that they are opposed to each other via the swash plate to form an imaginary sphere.

As the swash plate rotates, each piston reciprocates within a corresponding one of the cylinder bores, whereby refrigerant gas within the cylinder bore is compressed.

In a swash plate compressor for use in a typical refrigeration cycle system using a chlorofluorocarbon as a refrigerant, an imaginary sphere formed by a pair of shoes has a diameter which is approximately half as large as an outer diameter of each piston.

On the other hand, in a swash plate compressor for a transcritical refrigeration cycle system using carbon dioxide ($CO_2$) as a refrigerant, delivery quantity or capacity of the compressor is approximately a sixth of that of the compressor using the chlorofluorocarbon, due to differences in properties between the two refrigerants. Therefore, each piston of the compressor using $CO_2$ has an outer diameter smaller than that of the piston of the compressor using chlorofluorocarbon. More specifically, the former may be less than half of the latter.

However, since the transcritical refrigeration cycle is a high-pressure cycle in which load applied to shoes by compression pressure during each compression stroke is no lower than when the chlorofluorocarbon is compressed, it is required that the imaginary sphere formed by the pair of shoes has a diameter which is substantially equal to or slightly larger than the outer diameter of the piston, in view of rigidity of the shoes and slidability between the shoes and the swash plate.

Therefore, if the conventional construction of the piston (in which the bridge and the front end portion do not extend radially outward with respect to the peripheral surface of the body) is employed, it is inevitably required to reduce the shoes in size, which makes it impossible to obtain the required rigidity and slidability of the shoes.

SUMMARY OF THE INVENTION

It is an object of the present invention to provide a swash plate compressor which is capable of employing shoes suitable in size for a load applied to the shoes and a sliding condition of the shoes.

To attain the above object, the present invention provides a swash plate compressor comprising:

a cylinder block having a plurality of cylinder bores axially formed therethrough;

a housing secured to the cylinder block and having a crankcase defined therein;

a drive shaft extending through the crankcase;

a swash plate received within the crankcase and mounted on the drive shaft, for rotation in unison with the drive shaft, the swash plate having sliding surface on one side facing toward the cylinder block and another side remote from the cylinder block, respectively;

a plurality of pairs of shoes each having a substantially semispherical shape, each pair of the shoes sliding on the sliding surfaces of the swash plate on the one side and the another side, respectively;

a plurality of pistons received in the cylinder bores, respectively, the pistons each connected to the swash plate via a corresponding pair of the pairs of shoes and performing a linear reciprocating motion within a corresponding one of the cylinder bores, as the swash plate rotates; and a plurality of guide grooves each axially formed in an inner peripheral wall of the housing in a manner such that the guide grooves each extend along a path of the linear reciprocating motion of a corresponding one of the pistons, the pistons each having:

a body having a first concave portion formed therein for supporting one of a corresponding pair of the pairs of shoes, a swash plate-side end having a second concave portion formed therein for supporting another of the corresponding pair of the pairs of shoes, and a bridge formed integrally with the body and the swash plate-side end, the bridge integrally connecting the body and the swash plate-side end in a manner such that the first concave portion and the second concave portion are axially opposed to each other with space therebetween, the bridge extending radially outward with respect to a peripheral surface of the body of the piston, and being slidably fitted in a corresponding one of the guide grooves, wherein the pistons are made of an aluminum-based material, wherein the shoes are made of an iron-based material, and wherein a ratio of an outer diameter of the body to a diameter of an imaginary sphere formed by the corresponding pair of the pairs of shoes is within a range of 8/10 to 9/10.

According to this swash plate compressor, the bridge of each of the piston is formed radially outward with respect to the outer peripheral surface of the body of the piston. Therefore, the first and second concave portions are formed to have a sufficiently large size, allowing each shoe to have a correspondingly large size which ensures required rigidity of the shoe.

Preferably, the swash plate compressor includes a bearing supporting one end of the drive shaft, the cylinder block having a central portion formed with a bearing-receiving chamber for receiving the bearing therein, and at least one lubricant supply passage for supplying lubricant collected in at least one of the guide grooves to the bearing-receiving chamber.

According to this preferred embodiment, the bridge of the piston reciprocates within the guide groove along the path of the linear reciprocating motion of the piston to thereby supply lubricant from the guide groove to the bearing-receiving chamber via the lubricant supply passage. This ensures lubrication of the bearing within the bearing-receiving chamber, which improves durability of the bearing.

Preferably, the at least one of the guide grooves includes a guide groove formed at a lowermost location of the inner peripheral wall of the housing.

Preferably, the at least one lubricant supply passage opens into a cylinder block-side end of a corresponding one of the guide grooves.

The above and other objects, features and advantages of the present invention will become more apparent from the following detailed description taken in conjunction with accompanying drawings.

DETAILED DESCRIPTION OF THE PREFERRED EMBODIMENT

The present invention will now be described in detail with reference to drawings showing a preferred embodiment thereof.

Figure 1:
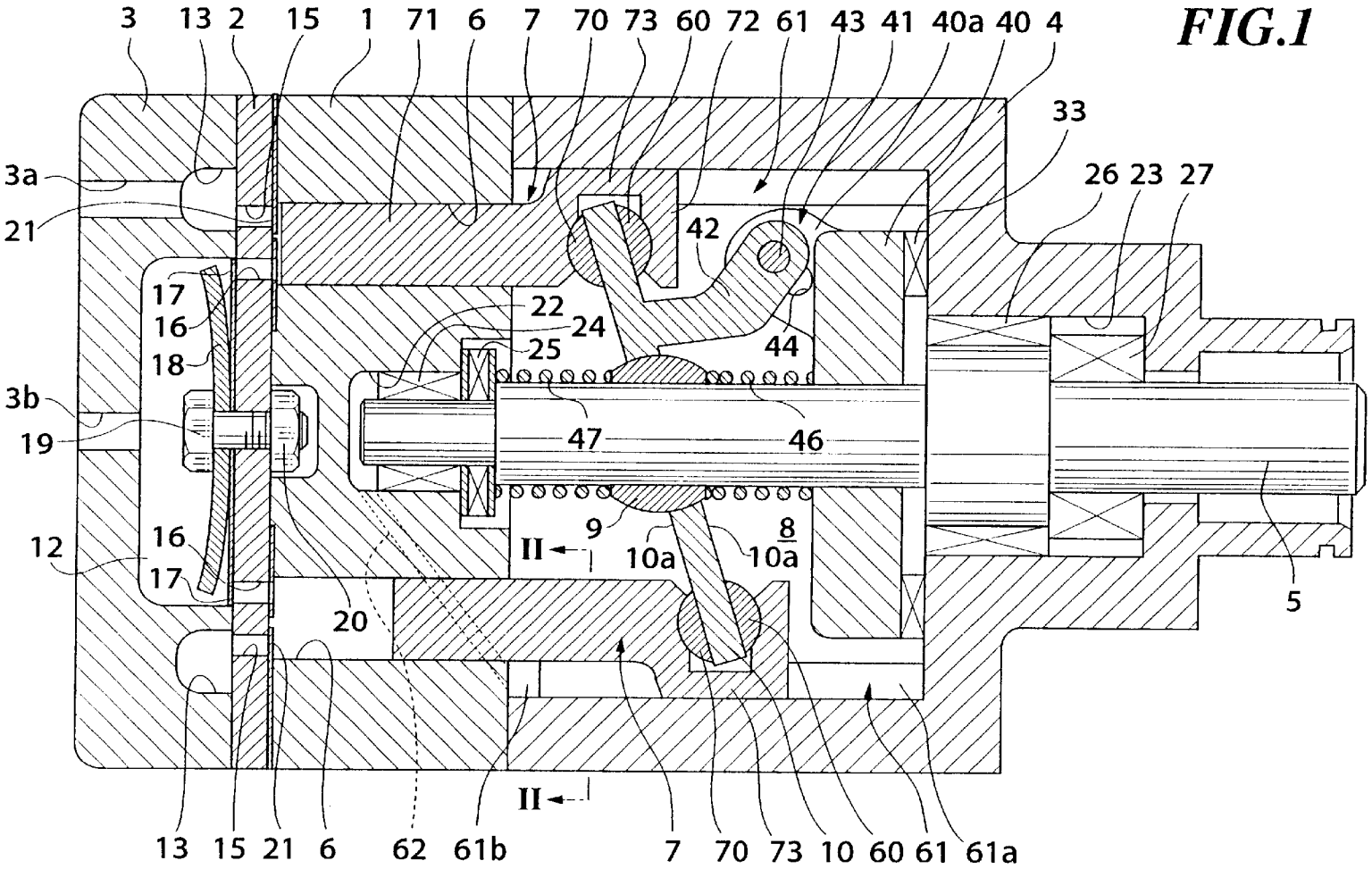
FIG. 1 is a longitudinal cross-sectional view showing the whole arrangement of a variable capacity swash plate compressor according to an embodiment of the present invention.
Figure 2:
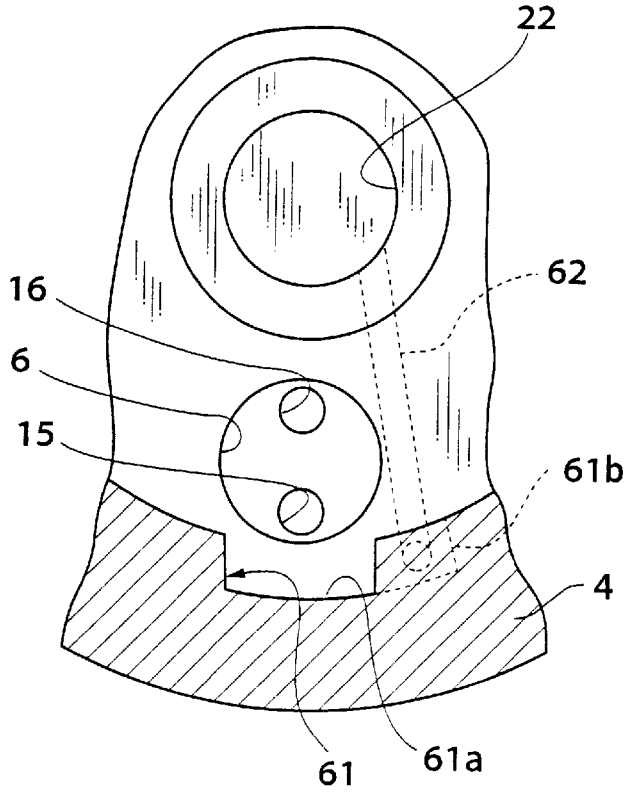
FIG. 2 is a cross-sectional view taken on line II—II of FIG. 1.
Figure 3:
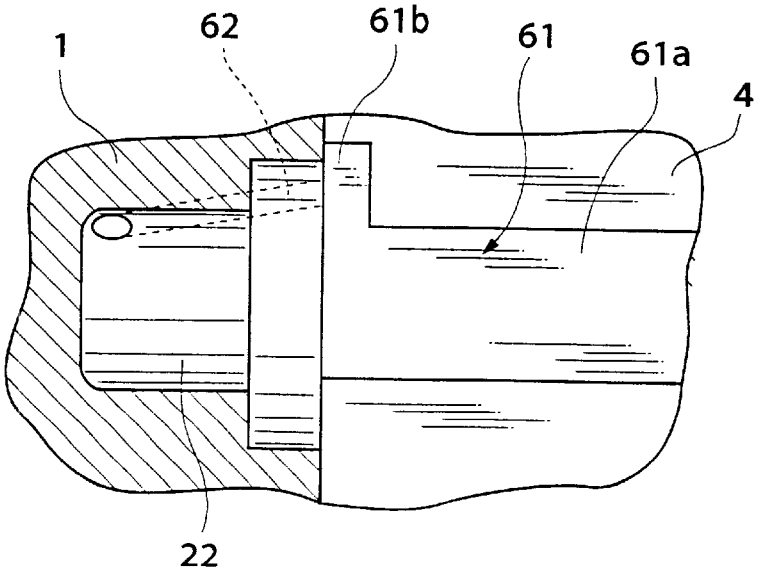
FIG. 3 is an enlarged sectional view showing a guide groove and a bearing-receiving chamber.
Figure 4:
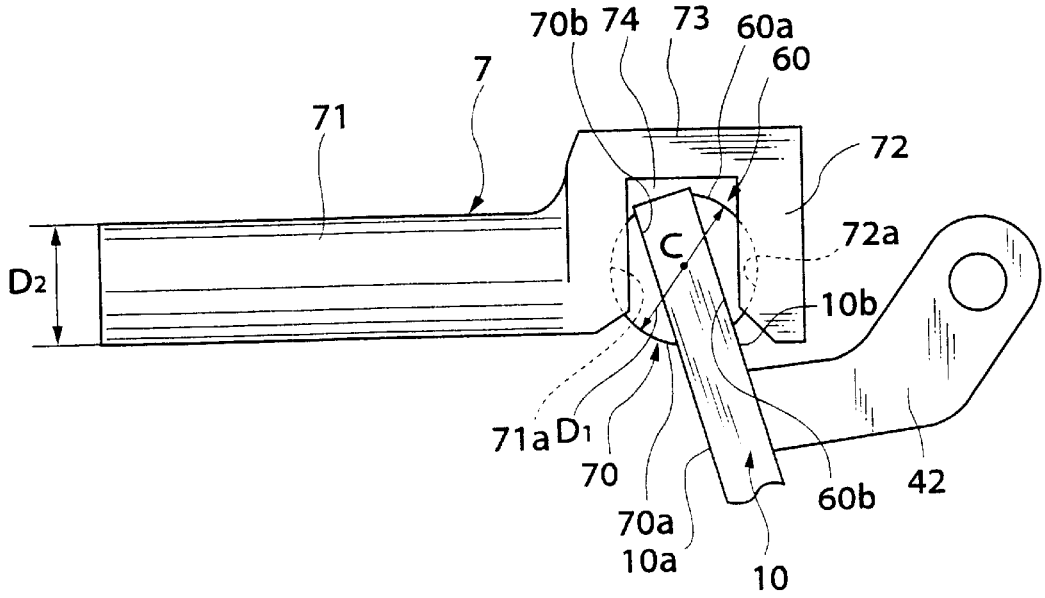
FIG. 4 is an enlarged side view showing a piston, a pair of shoes, and a swash plate.
Figure 5:
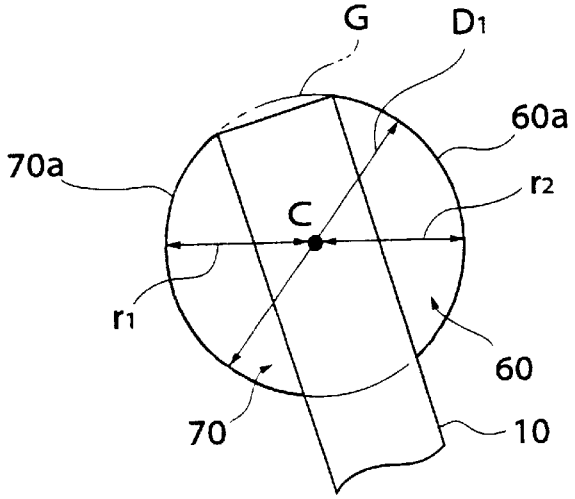
FIG. 5 is a view showing an imaginary sphere formed by the pair of shoes.

FIG.1 shows the whole arrangement of a variable capacity swash plate compressor according to an embodiment of the present invention. FIG. 2 is a cross-sectional view taken on line II—II of FIG. 1. FIG. 3 shows a guide groove and a bearing-receiving chamber on an enlarged scale, while FIG. 4 shows a piston, a swash plate, and a pair of shoes on an enlarged scale. FIG. 5 shows an imaginary sphere formed by the pair of shoes.

The variable capacity swash plate compressor has a cylinder block 1 having one end thereof secured to a rear head 3 via a valve plate 2 and the other end thereof secured to a front head (housing) 4.

The cylinder block 1 has a plurality of cylinder bores 6 axially extending therethrough at predetermined circumferential intervals about a drive shaft 5. Each cylinder bore 6 has the piston 7 slidably received herein.

The front head 4 defines a crankcase 8 in which are received the swash plate 10 and other components related thereto. The swash plate 10 is fitted on the drive shaft 5, for rotation in unison with the drive shaft 5. The swash plate 10 has each piston 7 connected thereto via the pair of shoes 60, 70, and the piston 7 reciprocates within the cylinder bore 6 as the swash plate 10 rotates.

As shown in FIG. 4, the piston 7 is comprised of a body 71 formed with a concave portion (first concave portion) 71*a* for slidably supporting one shoe 70, a front end portion 72 formed with a concave portion (second concave portion) 72*a* for slidably supporting the other shoe 60, and a bridge 73 integrally formed with the body 71 and the front end portion 72 for connecting the two portions 71, 72 to each other.

The concave portions 71*a* and 72*a* are opposed to each other in a direction of reciprocation of the piston 7, with space 74 therebetween.

The bridge 73 is formed in a manner protruding radially outward from a peripheral surface of the body 71 in a direction of the inner peripheral surface of the front head 4 (see FIG. 4).

The shoe 60(70) has a convex portion 60*a* (70*a*) slidably fitted in the concave portion 72*a* (71*a*) and a flat portion 70*b* (60*b*) which is in sliding contact with a sliding surface 10*a* (10*b*) of the swash plate 10.

As shown in FIG. 5, a radius of curvature r1 of the convex portion 70*a* of the shoe 70 is equal to a radius of curvature r2 of the convex portion 60*a* of the shoe 60, and the convex portions 70*a*, 60*a* have an identical center of curvature C in common. The shoes 60, 70 are arranged in a manner sandwiching the swash plate 10 to form an imaginary sphere G having the center of curvature C as a center thereof.

The ratio of the diameter D2 of the body 71 of each piston 7 to a diameter D1 of the imaginary sphere G formed by the pair of shoes 60 and 70 associated with the piston 7 is within a range of 8/10 to 9/10. To reduce wear between the piston 7 and the shoes 60 and 70, it is necessary to prevent an excessively large surface pressure from acting on the shoes 60 and 70. Therefore, the shoes 60 and 70 are required to be increased in size to some extent such that the diameter D1 has an appropriately large value.

However, if the diameter D1 of the imaginary sphere G is set to be too large, the thickness of the bridge 73 is required to be increased, and at the same time, the bridge 73 largely protrudes outwardly to increase the outer diameter of the compressor. When the use of the compressor or installation on a vehicle is considered, the outer diameter of the compressor cannot be made very large. Further, if the weight of shoes 60 and 70 or the bridge 73 increases, the variable controllability is degraded (destroking becomes difficult to be carried out).

Consequently, the diameter of the imaginary sphere G of the shoes 60 and 70 cannot be increased much.

According to the present invention, by setting the ratio of the outer diameter D2 of the body 71 of the piston 7 to the diameter D1 of the imaginary sphere G formed by each pair of shoes 60 and 70 within a range of 8/10 to 9/10, it is possible to prevent an excessively large surface pressure from acting on the shoes 60 and 70, and at the same time prevent the outer diameter of the compressor from becoming too large, while suppressing an increase in the weight of the shoes 60 and 70 and the bridge 73.

The piston 7 is made of an aluminum-based material such as an Al-Si alloy. The shoes 60 and 70 are made of an iron-based material such as a bearing steel having a composition, for example, comprising 0.95 to 1.1 weight % C, 0.15 to 0.35 weight % Si, ≦0.5 weight % Mn, 0.9 to 1.2 weight % Cr, and with the remainder being Fe.

A bearing-receiving chamber 22 is formed in a central portion of a front end face of the cylinder block 1. The bearing-receiving chamber 22 is open to the crankcase 8. Within the bearing-receiving chamber 22, there are received a radial bearing 24 and a thrust bearing 25. The bearings 24, 25 rotatably support a rear end of the drive shaft 5.

The rear head 3 defines a discharge chamber 12 and a suction chamber 13 surrounding the discharge chamber 12. Further, the rear head 3 is formed with a suction port 3*a* and a discharge port 3*b*. The suction port 3*a* communicates with a suction chamber 13, while the discharge port 3*b* communicates with a discharge chamber 12.

The valve plate 2 is formed with refrigerant outlet ports 16 for each communicating between a compression chamber within a corresponding one of the cylinder bores 6 and the discharge chamber 12, and refrigerant inlet ports 15 for each communicating between a compression chamber within a corresponding one of the cylinder bores 6 and the discharge chamber 12. The refrigerant outlet ports 16 and the refrigerant inlet ports 15 are arranged at predetermined circumferential intervals about the drive shaft 5. The refrigerant outlet ports 16 are opened and closed by respective discharge valves 17 formed as a unitary member. The unitary member of the discharge valves 17 is fixed to a rear head-side end face of the valve plate 2 by a bolt 19 and a nut 20, together with a valve stopper 18. On the other hand, the refrigerant inlet ports 15 are opened and closed by respective suction valves 21 formed as a unitary member arranged between the valve plate 2 and the cylinder block 1.

The front head 4 has a central portion of a front end thereof formed with a bearing-receiving chamber 23 through which a front end of the drive shaft 5 extends. The bearing-receiving chamber 23 has a radial bearing 26 and a sealing member 27 received therein. The radial bearing 26 rotatably supports the front end of the drive shaft 5.

Further, the cylinder block 1 is formed with a communication passage, not shown, for communicating between the suction chamber 13 and the crankcase 8. A pressure control valve, not shown, is arranged at an intermediate portion of the communication passage for controlling pressure within the suction chamber 13 and pressure within the crankcase 8.

The drive shaft 5 has a thrust flange 40 rigidly fitted on a front portion thereof, for transmitting torque from the drive shaft 5 to the swash plate 10. The thrust flange 40 is rotatably supported on an inner wall of the front head 4 by a thrust bearing 33 arranged between the thrust flange 40 and the inner wall of the front head 4. The thrust flange 40 and the swash plate 10 are connected with each other via a linkage 41. The swash plate 10 can tilt with respect to an imaginary plane perpendicular to the drive shaft 5.

The linkage 41 is comprised of an arm 42 extending from a surface of the swash plate 10, a pin 43 fixed to an end of the arm 42, and a projection 40*a* formed on the thrust flange 40 with a slot 44 formed therethrough. The pin 43 is engaged with the slot 44.

The swash plate 10 is fitted on the drive shaft 5 via a hinge ball 9 axially slidably mounted on the drive shaft 5.

On the drive shaft 5 is fitted a coil spring 46 between the thrust flange 40 and the hinge ball 9 to urge the hinge ball 9 in a direction of decreasing the inclination of the swash plate 10, while a coil spring 47 is fitted on the drive shaft 5 between the hinge ball 9 and the cylinder block 1 to urge the hinge 9 in a direction of increasing the inclination of the swash plate 10.

The swash plate 10, the thrust flange 40, and a portion of each piston 7 are received in the crankcase 8 as shown in FIG. 1. The crankcase 8 has an inner peripheral wall thereof formed with a plurality of guide grooves 61 each extending along a path of linear reciprocation motion of each piston 7, at predetermined circumferential intervals. Each of the guide grooves 61 has the bridge 73 of a corresponding one of the pistons 7 slidably fitted therein.

As best shown in FIG. 3, the guide groove 61 includes a groove 61*a* and a lubricant-collecting recess 61*b*. The lubricant-collecting recess 61*b* is formed such that it extends from a cylinder block-side end of the groove 61*a* at right angles to the groove 61*a*.

One guide groove 61 that is located at the bottom of the crankcase 8 (i.e., the lowermost guide groove 61 as viewed in FIG. 1) has the lubricant-collecting recess 61*b* thereof communicating with the bearing-receiving chamber 22 via a lubricant supply passage 62 formed within the cylinder block 1 as shown in FIGS. 2 and 3.

Next, the operation of the variable capacity swash plate compressor constructed as above will be described.

The torque of an engine, not shown, installed on an automotive vehicle, not shown, is transmitted to the drive shaft 5 to rotate the same. The torque is transmitted from the drive shaft 5 to the swash plate 10 via the thrust flange 40 and the linkage 41 to cause rotation of the swash plate 10.

When the swash plate 10 is rotated, the shoes 60, 70 slide along the sliding surface 10*a*, 10*b* of the swash plate 10. Because of the angle that the swash plate 10 forms with the imaginary plane perpendicular to the drive shaft 5, the torque transmitted from the swash plate 10 is converted into the reciprocating motion of each piston 7. As the piston 7 reciprocates within the cylinder bore 6 associated therewith, the volume of a compression chamber within the cylinder bore 6 changes. As a result, suction, compression and delivery of refrigerant gas are sequentially carried out in the compression chamber, whereby high-pressure refrigerant gas is delivered from the compression chamber in an amount corresponding to the inclination of the swash plate 10. During the suction stroke of the piston 7, the corresponding suction valve 21 opens to draw low-pressure refrigerant gas from the suction chamber 13 into the compression chamber within the cylinder bore 6. During the discharge stroke of the piston 7, the corresponding discharge valve 17 opens to deliver high-pressure refrigerant gas from the compression chamber to the discharge chamber 12.

In accordance with the reciprocating motion of the piston 7 within the cylinder bore 6, the bridge 73 of the piston 7 reciprocates along the groove 61*a* of the guide groove 61 in the direction of reciprocation of the piston 7. As the bridge 73 reciprocates, lubricant trapped within the groove 61*a* is collected by the bridge 73 in the lubricant-collecting recess 61*b* and supplied to the bearing-receiving chamber 22 via the lubricant supply passage 62. The lubricant in the bearing-receiving chamber 22 is supplied to the radial bearing 24 and the thrust bearing 25, followed by being returned to the crankcase 8. Thus, the radial bearing 24 and the thrust bearing 25 are lubricated.

When thermal load on the compressor decreases to lower the pressure in the suction chamber 13, the pressure control valve closes to interrupt communication between the crankcase 8 and the suction chamber 13. As a result, the pressure within the crankcase 8 is increased by blow-by gas leaking into the crankcase 8 from the compression chambers, to decrease the inclination of the swash plate 10. Accordingly, the length of stroke of the piston 7 is decreased to reduce the delivery quantity or capacity of the compressor.

On the other hand, when the thermal load on the compressor increases, the pressure control valve opens to communicate between the crankcase 8 and the suction chamber 13. As a result, the blow-by gas leaked into the crankcase 8 from the compression chambers escapes into the suction chamber 13, so that the pressure within the crankcase 8 is lowered to increase the inclination of the swash plate 10, whereby the length of stroke of the piston 7 is increased to increase the delivery quantity or capacity of the compressor.

According to the variable capacity swash plate compressor, the bridge 73 of the piston 7 extends radially outward from the peripheral surface of the body 71 thereof and is slidably engaged with the opposed guide groove 61 formed in the inner peripheral wall of the front head 4 in a manner extending in the direction of reciprocation of the piston 7, so that it is possible to set the ratio of the outer diameter D2 of the body 71 of the piston 7 to the diameter D1 of the imaginary sphere G formed by the pair of shoes 60 and 70 within the range of 8/10 to 9/10. Further, the piston 7 is made of an aluminum-based material, and the shoes 60 and 70 are made of an iron-based material. Therefore, it is possible to form the shoes 60, 70 such that they have required rigidity, and hence makes the variable capacity swash plate compressor according to an embodiment suitable for a refrigerant compressor for use in a transcritical refrigeration cycle system using, e.g., carbon dioxide as a refrigerant.

Further, the bridge 73 of the piston 7 reciprocates in the groove 61*a* of the guide groove 61 in the direction of reciprocation of the piston 7, whereby lubricant is collected in the lubricant-collecting recess 61*a* and supplied to the bearing-receiving chamber 22 via the lubricant supply passage 62. This makes it possible to lubricate the radial bearing 24 and the thrust bearing 25 within the bearing-receiving chamber 22, enhancing the durability of the two bearings 24 and 25.

Although in the above embodiment, only one guide groove 61 out of the plurality of guide grooves 61, which is located at the bottom of the crankcase 8, communicates with the bearing-receiving chamber 22, this is not limitative, but each of the plurality of guide groves 61 may communicate with the bearing-receiving chamber 22.

However, to limit the required driving force for a minimum feeding of lubricant, it is preferable to employ the construction described in the above embodiment.

Further, it is possible to provide a check valve, not shown, at an intermediate portion of the lubricant supply passage 62, for permitting only a lubricant flow toward the bearing-receiving chamber 22. Moreover, it is also possible to progressively reduce a cross-sectional area of the lubricant supply passage toward the bearing-receiving chamber 22. The former ensures a reliable supply of lubricant to the bearing-receiving chamber 22, while the latter improves lubricant feeding efficiency.

Although in the above embodiment, description is made of a case in which the invention is applied to a variable capacity swash plate compressor, this is not limitative, but the present invention may be applied to a fixed capacity swash plate compressor.

It is further understood by those skilled in the art that the foregoing is the preferred embodiment and variations of the present invention are possible, and that various changes and modifications may be made without departing from the spirit and scope thereof.

What is claimed is:

1. A swash plate compressor comprising:

a cylinder block having a plurality of cylinder bores axially formed therethrough;

a housing secured to said cylinder block and having a crankcase defined therein;

a drive-shaft extending through said crankcase;

a swash plate received within said crankcase and mounted on said drive shaft, for rotation in unison with said drive shaft, said swash plate having sliding surfaces on one side facing toward said cylinder block and another side remote from said cylinder block, respectively;

a plurality of pairs of shoes each having a substantially semispherical shape, each pair of said shoes sliding on said sliding surfaces of said swash plate on said one side and said another side, respectively;

a plurality of pistons received in said cylinder bores, respectively, said pistons each connected to said swash plate via a corresponding pair of said pairs of shoes and performing a linear reciprocating motion within a corresponding one of said cylinder bores, as said swash plate rotates; and a plurality of guide grooves each axially formed in an inner peripheral wall of said housing in a manner such that said guide grooves each extend along a path of said linear reciprocating motion of a corresponding one of said pistons, said pistons each having:

a body having a first concave portion formed therein for supporting one of a corresponding pair of said pairs of shoes, a swash plate-side end having a second concave portion formed therein for supporting another of said corresponding pair of said pairs of shoes, and a bridge formed integrally with said body and said swash plate-side end, said bridge integrally connecting said body and said swash plate-side end in a manner such that said first concave portion and said second concave portion are axially opposed to each other with space therebetween, said bridge extending radially outward with respect to a peripheral surface of said body of said piston, and being slidably fitted in a corresponding one of said guide grooves, and wherein said pistons are made of an aluminum-based material, wherein said shoes are made of an iron-based material, and wherein a ratio of an outer diameter of said body to a diameter of an imaginary sphere formed by said corresponding pair of said pairs of shoes is within a range of 8/10 to 9/10.

2. The swash plate compressor according to claim 1, further comprising a bearing supporting one end of said drive shaft, said cylinder block having a central portion formed with a bearing-receiving chamber for receiving said bearing therein, and at least one lubricant supply passage for supplying lubricant collected in at least one of said guide grooves to said bearing-receiving chamber.

3. The swash plate compressor according to claim 2, wherein said at least one of said guide grooves includes a guide groove formed at a lowermost location of said inner peripheral wall of said housing.

4. The swash plate compressor according to claim 2, wherein said at least one lubricant supply passage opens into a cylinder block-side end of a corresponding one of said guide grooves.

5. The swash plate compressor according to claim 1, wherein the aluminum-based material is an Al—Si alloy.

6. The swash plate compressor according to claim 1, wherein the iron-based material is a bearing steel having a composition comprising 0.95 to 1.1 weight % C, 0.15 to 0.35 weight % Si, ≦0.5 weight % Mn, 0.9 to 1.2 weight % Cr and the remainder being Fe.

7. The swash plate compressor according to claim 5, wherein the iron-based material is a bearing steel having a composition comprising 0.95 to 1.1 weight % C, 0.15 to 0.35 weight % Si, ≦0.5 weight % Mn, 0.9 to 1.2 weight % Cr and the remainder being Fe.

* * * * *